US007121131B2

(12) United States Patent
Uribe Quintanilla et al.

(10) Patent No.: US 7,121,131 B2
(45) Date of Patent: Oct. 17, 2006

(54) WATER COOLED PANEL AND FORMING METHOD

(75) Inventors: Antonio Uribe Quintanilla, Monterrey (MX); Jorge Carlos Gonzalez Cruz, San Pedro Garza Garcia (MX)

(73) Assignee: Melter S.A. De C.V., Apodaca (MX)

( * ) Notice: Subject to any disclaimer, the term of this patent is extended or adjusted under 35 U.S.C. 154(b) by 138 days.

(21) Appl. No.: 10/769,904

(22) Filed: Feb. 3, 2004

(65) Prior Publication Data

US 2005/0103085 A1 May 19, 2005

(30) Foreign Application Priority Data

Nov. 17, 2003 (MX) ..... NL/a/2003/000043

(51) Int. Cl.
*B21D 7/16* (2006.01)

(52) U.S. Cl. ..... 72/369; 72/128; 72/342.5; 72/364

(58) Field of Classification Search ..... 72/342.5, 72/369, 364, 388, 214, 384, 57, 128, 367.1, 72/217; 29/890.045, 890.046, 890.047, 890.048, 29/890.049, 890.05, 890.053; 165/DIG. 135
See application file for complete search history.

(56) References Cited

U.S. PATENT DOCUMENTS

| | | | | |
|---|---|---|---|---|
| 3,229,489 | A * | 1/1966 | Huet | 72/128 |
| 3,753,635 | A * | 8/1973 | Barnett | 425/162 |
| 5,491,996 | A * | 2/1996 | Baarman et al. | 72/128 |
| 6,038,902 | A * | 3/2000 | Talley et al. | 72/128 |
| 6,309,588 | B1 * | 10/2001 | Powell et al. | 264/570 |
| 6,715,202 | B1 * | 4/2004 | Beaver | 29/727 |

FOREIGN PATENT DOCUMENTS

| | | | |
|---|---|---|---|
| GB | 2146558 | A * | 4/1985 |
| JP | 62013218 | A * | 1/1987 |

* cited by examiner

*Primary Examiner*—Dmitry Suhol
(74) *Attorney, Agent, or Firm*—Young & Thompson

(57) ABSTRACT

A bending method for producing a coil using a thick wall pipe, comprising a simultaneous hot bending and pressing of the pipe by which it is possible to obtain a coil without welded 180° elbows since the return sections are integral part of the pipe.

11 Claims, 3 Drawing Sheets

WATER COOLED PANEL AND FORMING METHOD

BACKGROUND OF THE INVENTION

A. Field of the Invention

The present invention is related to water cooled panels for electric arc furnaces and more particularly to a water cooled panel having a tubular design comprised by a coil formed by a thick wall pipe in which the 90° & 180° elbows are integral to the tube, and to its forming method.

B. Description of the Related Invention

Temperatures higher than 2300° F. are generated inside the electric arc furnaces, therefore, in order to avoid structural damages, water cooled panels are used in order to maintain the temperature of the structure below the failing point.

Typically, an electric arc furnace has several cooling systems. Normally, those systems comprise a cooling liquid recirculation circuit passing through all the elements of the furnace exposed to high temperatures. The water circulating inside the circuits, passes through the elements that need to be cooled such as Shell & Roof panels, gas exhaust Ducts, etc., in order to remove heat from those elements and subsequently transfer that heat to the environment using a cooling tower or an equivalent device.

The cooling circuit is typically comprised by several feeding pumps, return pumps, filters, one or more cooling towers as well as supervision and control instruments. The key elements of the furnace normally have instruments to monitor the flow, pressure and temperature of the water.

For most water cooled equipment, a flow interruption or an inadequate volume of water circulating through the cooling system may cause a serious thermal overload and sometimes a catastrophic failure.

Current electric arc furnaces have a variable quantity of water cooled panels mounted on a support frame, which allows for quick individual replacement of each panel. By cooling the furnace structure, thermal expansion and thermal stress are avoided which may cause gaps between panels. Water cooled panels allow the furnace to withstand high temperatures without suffering any structural damage. In old design electric arc furnaces, such high temperatures may have caused a higher erosion rate of the refractory walls and damages to the furnace shell.

Furthermore, cooling coils are used in the gas exhaust Ducts in order to cool said Ducts and avoid a structural damage and to cool down the gases to an adequate temperature for the filters to which the gases are conducted.

Typically the water cooled panels have a tubular design and comprise a hydraulic circuit requiring more than one pipe. In order to conduct the water from one pipe to the next one in the circuit, 90° & 180° elbows are used. This kind of hydraulic circuit is normally called "coil".

The use of said 180° elbows allows for a gap between the pipes that ranges from 0 to approximately a distance equivalent to the diameter of the pipe. Said 180° elbows are formed (cast, forged) independently of the pipes and are welded to the end of each pipe.

The process of welding an elbow to the ends of the pipes is costly, time consuming and creates a potential failure point.

Furthermore, the internal welded seams may cause additional pressure losses when the coil is in operation, reducing the eficiency of the entire cooling system.

Based on the above referred problems, the applicant developed a novel pipe bending method, comprising a simultaneous hot bending and pressing of the pipe by which it makes possible to obtain a coil without welded 180° elbows since they are integrally formed with the pipe.

By using the above referred novel process it is possible to bend a thick wall pipe to obtain a 180° elbow, with a gap between straight pipe sections which can go down to zero inches.

The method of the present invention may be applied to pipes made of carbon steel, copper (and its alloys), stainless steel, low alloy steel, aluminum, etc. in order to produce tubular cooling coils for electric arc furnaces elements such as shell & roof panels, tunnels, slag doors, sump panels, deltas, rings, ducts, drop out boxes, post-combustions chambers, etc.

The water pressure losses obtained with the novel method are equal or lower than the pressure losses obtained with the coils having welded elbows, thus optimizing the amount of electric energy used by the pumps which circulate the water through the cooling system.

SUMMARY OF THE INVENTION

It is therefore a main object of the present invention to provide a novel pipe bending method comprising a simultaneous hot bending and pressing of the tube.

It is another object of the present invention, to provide a bending method of the above referred nature by which is possible to form a coil without welded 180° elbows since the return sections are integral part of the pipe.

It is yet another object of the present invention to provide a bending method of the above referred nature by which it is possible to bend a thick wall pipe to obtain a 180° elbow with a gap between straight pipe sections which may be of zero inches.

It is still another object of the present invention to provide a bending method of the above referred nature which may be applied to pipes made of carbon steel, copper (and its alloys), stainless steel, low alloy steel, aluminum, etc. in order to produce tubular cooling coils for electric arc furnace elements such as shell & roof panels, tunnels, slag doors, sump panels, deltas, rings, ducts, drop out boxes, post-combustion chambers, etc.

It is an additional object of the present invention to provide a bending method of the above referred nature by which it is possible to form coils in which the water pressure losses are equal or less than the pressure losses obtained with coils using welded elbows, thus optimizing the amount of electric energy used by the pumps which circulate the water through the cooling system.

These and other objects and advantages of the bending method of the present invention will become apparent to those persons having an ordinary skill in the art, from the following detailed description of the embodiments of the invention, which will be made with reference to the accompanying drawings.

DETAILED DESCRIPTION OF THE INVENTION

Figure 1:
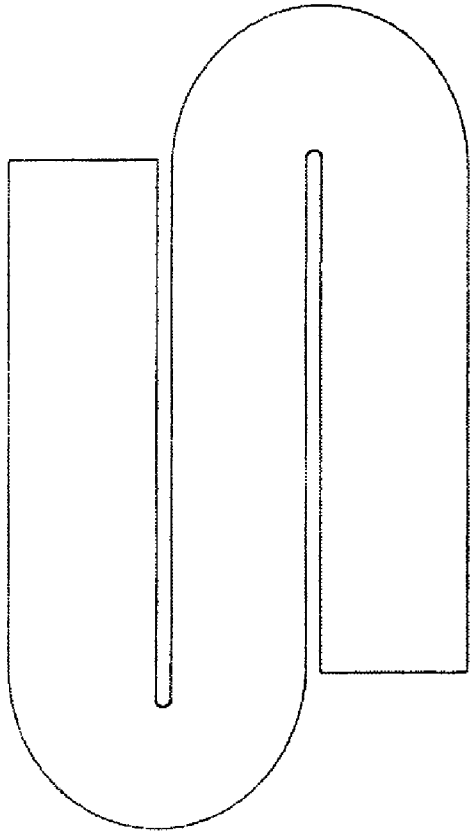
FIG. 1 is a front view of a coil section having a tubular design formed by the bending method of the present invention.

The invention will now be described making reference to a preferred embodiment thereof and to specific examples of the method and specific materials used to form a coil without welded 180° elbows, wherein the method of the present invention comprises:

Providing a pipe made of a metallic material selected form the group consisting of: carbon steel, copper and its alloys, stainless steel, low alloy steel, aluminum, etc. and of the type selected from the group consisting of: conventional or seamless, extruded, ribbed (splined), within a thickness ranging from schedule 40 to schedule XXS;

defining a tangency point where a bend will occur;

pre-heating the pipe by means of the flame of an oxi-gas torch at the tangency point plus approximately 2" at a temperature of between 570° F. to 2200° F. for a time of between 30 seconds to 60 minutes and at a distance between the torch tip and the pipe that depends on the pipe material and thickness. An adequate pre-heating allows the material to yield when carrying out subsequent bending steps, minimizing deformations;

pre-bending the pipe 180° using as reference the tangency point as bending point in order to obtain a "U" shaped piece having two straight sections depending of a bent section, using conventional means which may comprise any bending tool, until a bending radius R/D of 1 to 3 is obtained wherein R=bending radius and D=external pipe diameter;

heating the bent section in a special gas or induction furnace at a temperature of between 570° F. to 2200° F. and for a time of between 1 to 60 minutes depending on the pipe material and thickness;

immediately after removing the bent section from the furnace, introducing it to a special press having two lateral pressure elements, each applying a lateral pushing force along a straight section respectively for a distance of approximately 12" from the bent section, and a pressure element which applies a pushing force on the tangency point perpendicular to the lateral pushing forces, in order to provide to the "U" shaped piece the required final bending radius. As a result of this step, the cross sections of the straight and bent section acquire an oval shape;

applying a vertical compression force to the entire "U" shaped piece in order to round the straight and bent sections until the required roundness is obtained, by means of a press including a mold having the shape of the "U" shaped piece with the required roundness;

repeat the above described steps until forming all the required return sections of a coil.

If the pipe to be processed is made out of alloy steel, then a thermal treatment after the last step of the process is required. If the pipe to be processed is made of stainless steel, then a solution thermal treatment is necessary after the last step of the process.

Although it was described that the pre-heating is carried out by an oxi-gas torch, it can be obtained by induction or by any other means.

By the process of the present invention, it is possible to obtain bending radius R/D within a range of 0.5 to 3.

The coil produced by the method of the present invention such as the one shown in FIG. 1, has the advantage of achieving lower or equal pressure losses in comparison with the coils having welded 180° elbows as shown in the following examples:

EXAMPLE 1

A coil was formed having the following characteristics:
Pipe material: A106-Gr B
Pipe dimensions: 2½" Ø, Sch. 80
Number of 180° elbow sections: 9
Pipe lenght (without 180° elbow sections): 32 ft.
Water cooled area: 8.7 $ft^2$ Results:

Bending radius: 0.5 D (separation between straight sections 0.0 in)

Figure 2:
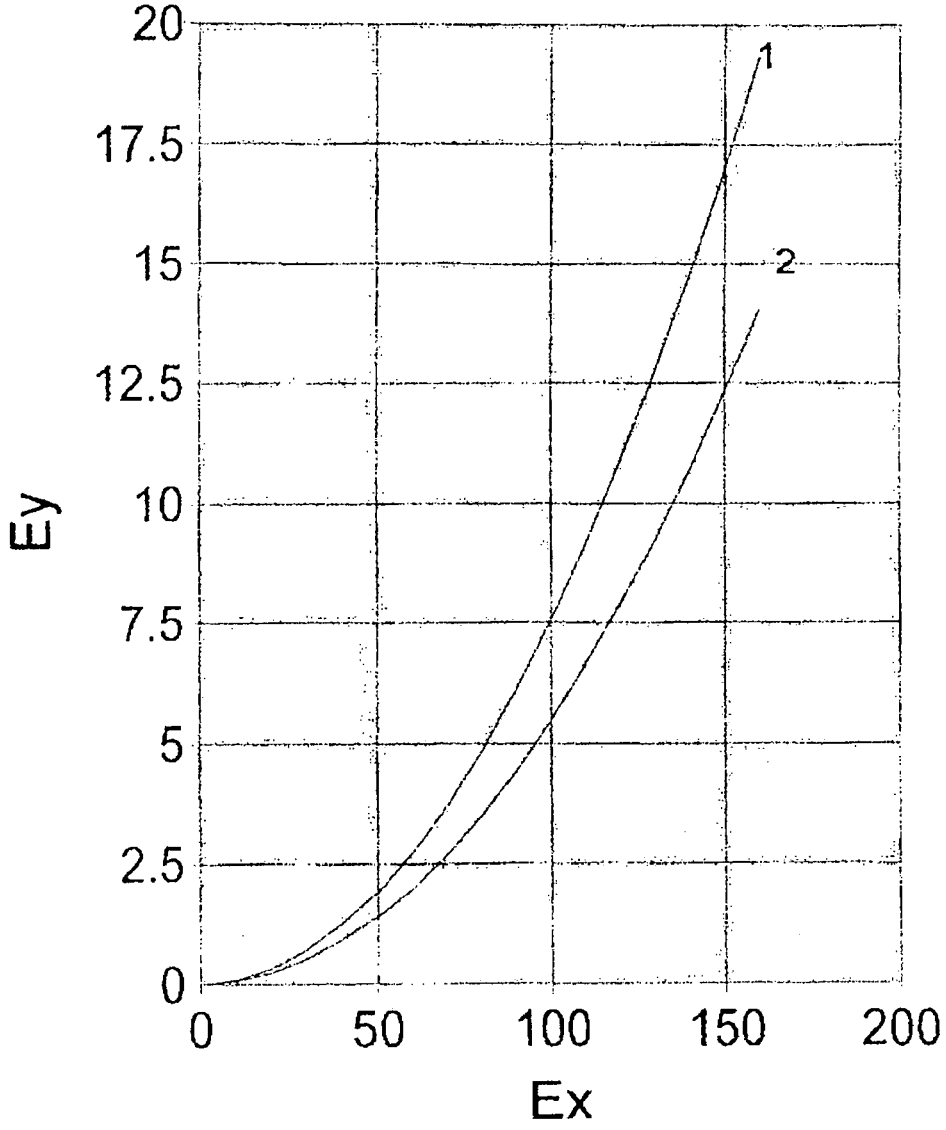
FIG. 2 is a graph showing the pressure losses of a coil fabricated with 2½" schedule 80 pipe using 180° welded elbows versus the pressure losses of a coil fabricated with 2½" schedule 80 pipe with 180° elbows formed by the bending method of the present invention.

Pressure losses: lower than the pressure losses of a coil having the same size but using welded elbows, as shown in Table 1 and the graph of FIG. 2, wherein: Ex shows the "X" axis representing a flow scale in gallons per minute (gpm); Ey shows the "Y" axis representing pressure losses scale in psi; 1 represents the pressure losses curve produced by a coil using welded elbows; and 2 represent the pressure losses curve obtained by the coil using bent sections produced by the method of the present invention.

TABLE 1

PRESSURE LOSSES COMPARISON CHART FOR SCH. 80 PIPE. COIL USING WELDED 180° ELBOWS VS COIL FORMED BY THE PROCESS OF THE PRESENT INVENTION

| | PRESSURE LOSSES (PSI) | | |
|---|---|---|---|
| FLOW (GPM) | BENT PIPE | WITH WELDED 180° ELBOWS | DIFERENCE % |
| 0 | 0 | 0 | 0.0000 |
| 10 | 0.06001624 | 0.08084368 | 25.7626 |
| 20 | 0.23162623 | 0.31493599 | 26.4529 |
| 30 | 0.51099019 | 0.69843715 | 26.8381 |
| 40 | 0.89629347 | 1.22953250 | 27.1029 |
| 50 | 1.38634242 | 1.90702840 | 27.3035 |
| 60 | 1.98025490 | 2.73004272 | 27.4643 |
| 70 | 2.68185495 | 3.70239948 | 27.5644 |
| 80 | 3.50283095 | 4.83578707 | 27.5644 |
| 90 | 4.43327043 | 6.12029301 | 27.5644 |
| 100 | 5.47317337 | 7.55591730 | 27.5644 |
| 110 | 6.62253977 | 9.14265994 | 27.5644 |
| 120 | 7.88136965 | 10.88052090 | 27.5644 |
| 130 | 9.24966299 | 12.76950020 | 27.5644 |
| 140 | 10.72741980 | 14.80959790 | 27.5644 |
| 150 | 12.31464010 | 17.00081390 | 27.5644 |
| 160 | 14.01132380 | 19.34314830 | 27.5644 |

EXAMPLE 2

A coil was formed having the following characteristics:
Pipe material: A106-Gr B
Pipe dimensions: 2½" Ø, Sch. 160
Number of 180° elbow sections: 9
Pipe length (without 180° elbow sections): 32 ft.
Water cooled area: 8.7 $ft^2$ Results:

Bending radius: 0.5 D (separation between straight sections 0.0 in)

Figure 3:
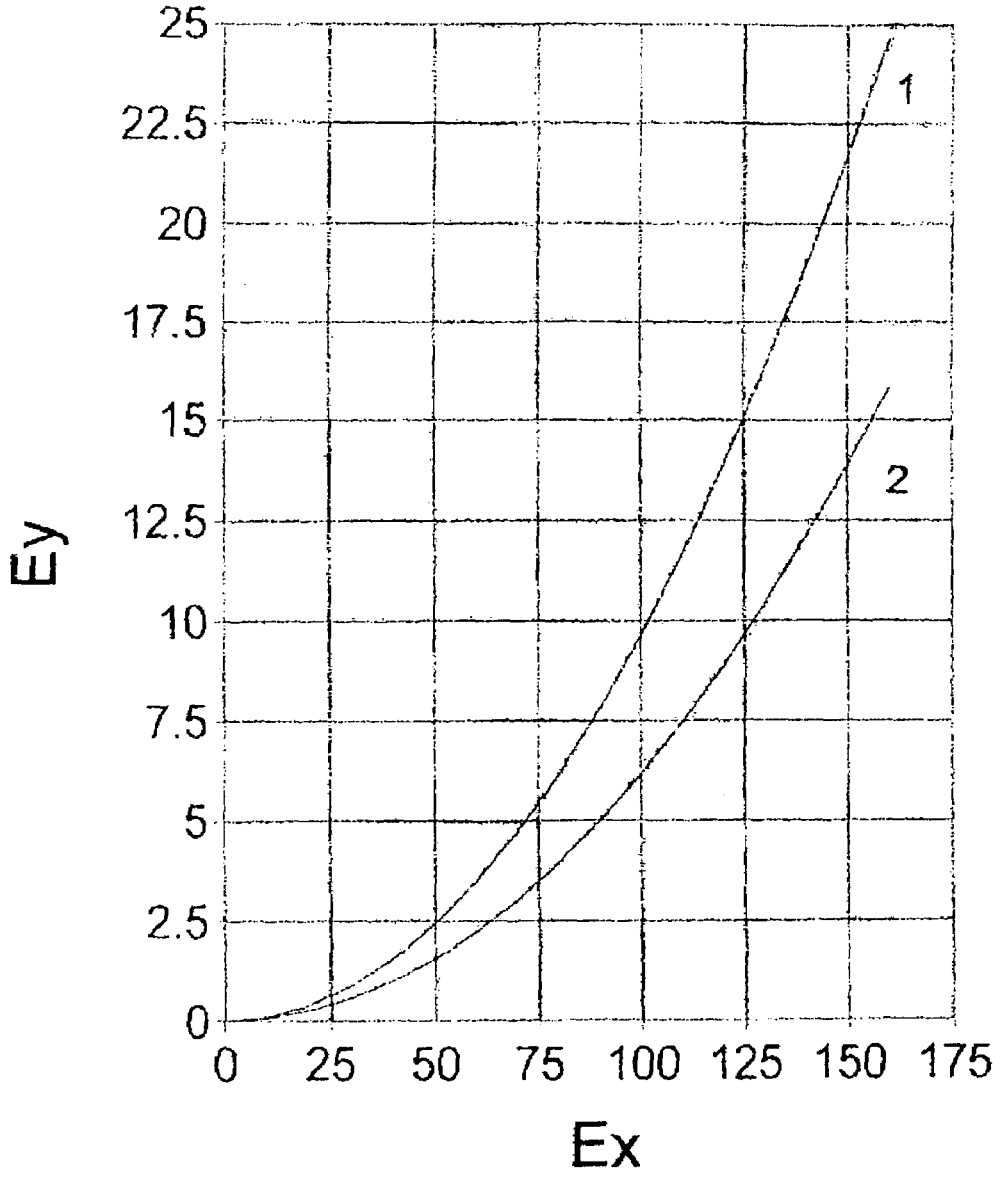
FIG. 3 is a graph showing the pressure losses of a coil fabricated with 2½" schedule 160 pipe using welded elbows versus the pressure losses of a coil formed with 2½" schedule 160 pipe with 180° elbows formed by the bending method of the present invention.

Pressure losses: lower than the pressure losses of a coil with the same size but using welded 180° elbows, as shown in Table 2 and FIG. 3 graph, wherein: Ex shows the "X" axis representing a flow scale in gallons per minute (gpm); Ey shows the "Y" axis representing a pressure loss scale in psi; 1 represents the pressure loss curve produced by a coil using welded 180° elbows; and 2 represents the pressure loss curve obtained by the coil having bent sections produced by the method of the present invention.

TABLE 2

PRESSURE LOSSES COMPARISON FOR SCH. 160 COIL USING WELDED 180° ELBOWS VS COIL FORMED BY THE PROCESS OF THE PRESENT INVENTION

| | PRESSURE LOSS (PSI) | | |
|---|---|---|---|
| FLOW (GPM) | BENT PIPE | WITH WELDED 180° ELBOWS | DIFFERENCE % |
| 0 | 0 | 0 | 0.0000 |
| 10 | 0.06991225 | 0.10453932 | 33.1235 |
| 20 | 0.26587133 | 0.40437959 | 34.2520 |
| 30 | 0.58160812 | 0.89325170 | 34.8887 |
| 40 | 1.01415987 | 1.56819290 | 35.3294 |
| 50 | 1.56157775 | 2.42725436 | 35.6648 |
| 60 | 2.21866089 | 3.46523521 | 35.9737 |
| 70 | 3.01984399 | 4.71657015 | 35.9737 |
| 80 | 3.94428603 | 6.16041816 | 35.9737 |
| 90 | 4.99198701 | 7.79677923 | 35.9737 |
| 100 | 6.16294692 | 9.62565337 | 35.9737 |
| 110 | 7.45716578 | 11.64704060 | 35.9737 |
| 120 | 8.87464357 | 13.86094090 | 35.9737 |
| 130 | 10.41538030 | 16.26735420 | 35.9737 |
| 140 | 12.07937600 | 18.86628060 | 35.9737 |
| 150 | 13.86663060 | 21.65772010 | 35.9737 |
| 160 | 15.77714410 | 24.64167260 | 35.9737 |

What is claimed is:

1. A bending method for producing a coil having return sections bent at 180° comprising the steps of:

providing a metallic pipe;

setting up a tangency point where a bend will occur;

pre-heating the pipe where the bend will occur at a temperature of between 570° F. to 2200° F. for a time of between 30 seconds to 60 minutes;

pre-bending the pre-heated pipe at 180° taking as bending reference point the tangency point in order to obtain a "U" shaped piece having two straight tube sections depending from a bent section;

heating the bent section at a temperature of between 570° F. to 2200° F. for a time between 1 to 60 minutes;

forming a final bending radius by applying a lateral pushing force along a straight section respectively and a pushing force on the tangency point perpendicular to the lateral pushing forces; and applying a compression force to the entire "U" shaped piece in order to round the sections until the required roundness is obtained.

2. A method as claimed in claim 1, wherein the pipe is made of a metallic material selected from the group consisting of: carbon steel, copper and its alloys, stainless steel, low alloy steel and aluminum.

3. A method as claimed in claim 1 wherein the metallic pipe is of the type selected from the group consisting of: welded or seamless, extruded, ribbed (splined).

4. A method as claimed in claim 1 wherein the pipe has a thickness ranging from schedule 40 to XXS.

5. A method as claimed in claim 1 wherein the pre-heating is carried out by using an oxi-gas torch.

6. A method as claimed in claim 1, wherein the pre-heating is applied at the tangency point plus approximately 2".

7. A method as claimed in claim 1, wherein the pre-bending is carried out by using conventional means which may comprise any bending tool.

8. A method as claimed in claim 1, wherein in the pre-bending step, the pipe is bent until a bending radius R/D of 1 to 3 is obtained; wherein R=bending radius and D=external tube diameter.

9. A method as claimed in claim 1, wherein the final bending radius is formed by using a special press having two lateral pressure elements, each applying a lateral pushing force along a straight section respectively, and a pressure element which applies a pushing force on the tangency point perpendicular to the lateral pushing forces.

10. A method as claimed in claim 1, wherein each lateral pushing force is applied along a straight section for a distance of approximately 12" from the bent section.

11. A method as claimed in claim 1, wherein each step is repeated until all the required return sections of the coil are formed.

* * * * *